US006199282B1

(12) United States Patent
Uchiyama et al.

(10) Patent No.: US 6,199,282 B1
(45) **Date of Patent: *Mar. 13, 2001**

(54) ELECTRIC SHAVER

(75) Inventors: Hiromi Uchiyama; Yukio Izumi, both of Matsumoto (JP)

(73) Assignee: Izuma Products Company, Nagano (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/098,298

(22) Filed: Jun. 16, 1998

(30) Foreign Application Priority Data

Jun. 17, 1997 (JP) ..... 9-159404

(51) Int. Cl.[7] ..... B26B 19/38; B26B 19/14
(52) U.S. Cl. ..... 30/43.6; 30/346.51
(58) Field of Search ..... 30/346.51, 43.6, 30/43.5

(56) References Cited

U.S. PATENT DOCUMENTS 2,494,464 * 1/1950 Vivie et al. ..... 30/346.51
4,393,586 7/1983 Hamashima et al. .

FOREIGN PATENT DOCUMENTS 909666 4/1954 (DE) .
0566292 10/1993 (EP) .
WO97/45235 12/1997 (WO) .

* cited by examiner

*Primary Examiner*—Douglas D. Watts
(74) *Attorney, Agent, or Firm*—Koda & Androlia

(57) ABSTRACT

An electric rotary shaver with one or a plurality of circular outer cutter units each formed with a plurality of blade formation regions of annular shapes concentrically arranged. The blade formation regions located outermost are formed greater in thickness than other blade formation regions(s), and hair-entry slits extending in the radial direction are formed in the blade formation regions so as to form slit-form blades. Thus, the slit-form blades in the blade formation regions other the outermost blade formation region is thinner than those of the outermost blade formation region thus allowing deep shaving and assuring a strength of the outer cutter unit.

4 Claims, 6 Drawing Sheets

ELECTRIC SHAVER

BACKGROUND OF THE INVENTION

1. Field of the Invention

The present invention relates to a rotary type electric shaver.

2. Prior Art

A conventional rotary type electric shaver will be described first.

As shown in FIGS. 10 and 11, an electric shaver is equipped with at least one shaving unit 54 that consists of a circular outer cutter unit 50 and a circular inner cutter unit 52 which is rotated relative to the outer cutter unit 50.

The outer cutter unit 50 is provided with two annular blade formation regions 56*a* and 56*b*, and a plurality of hair-entry slits 62*a* and 62*b* of the same width are formed so as to be side by side in the circumferential direction and extend in substantially radial configuration, thus forming slit-form blades 58*a* and 58*b* in the annular blade formation regions 56*a* and 56*b*. For the outer slit-form blades 58*a*, the side walls of the ribs 64*a* which are formed by two adjacent slits 62*a* of the outer blade formation region 56*a* act as blade surfaces for cutting whiskers; and likewise, for the inner slit-form blades 58*b*, the side walls of the ribs 64*b* which are formed by two adjacent slits 62*b* of the inner blade formation region 56*b* act as blade surfaces for cutting the whiskers.

Here, the term "substantially radial configuration" described above refers to the fact that the respective slits 62*a* and 62*b* are formed in a straight line so that the slits extend from the inner circumferences of the respective blade formation regions 56*a* and 56*b* to the outer circumferences of the blade formation regions with the slits inclined at a prescribed angle with respect to the radial direction extending from the center of each of the outer cutter units 50. In addition, the "prescribed angle" refers to an angle in the range of 0 degrees to 90 degrees (e. g., about 10 degrees). The same is true below. The respective slits 62*a* and 62*b* are formed in the respective blade formation regions 56*a* and 56*b* at equal angular (angle $\alpha$) intervals.

Furthermore, the inner cutter unit 50 is provided with inner blade bodies 60 which are disposed circumferentially. The tip ends of the respective inner blade bodies 60 are bifurcated as shown in FIG. 11, thus forming inner blade elements 60*a* and 60*b* which respectively contact the internal surfaces of the slit-form blades 58*a* and 58*b*. These inner blade elements 60*a* and 60*b* are arranged in concentric annular configurations so as to correspond to the annular blade formation regions 56*a* and 56*b* of the outer cutter unit 50.

With the structure described above, the slit-form blade 58*a* and inner blade elements 60*a* form an annular cutting blade assembly located around the outer circumference of the shaving unit 54, and the slit-form blade 58*b* and inner blade elements 60*b* form another cutting blade assembly located around the inner circumference of the shaving unit 54.

As shown in FIG. 11, in the prior art shaver, not only the thickness a and b of the respective slit-form blades 58*a* and 58*b* of the respective blade formation regions 56*a* and 56*b* of the outer cutter unit 50 are formed to be the same (a=b), but also the interior surfaces of the slit-form blades 58*a* and 58*b* arc positioned on the same plane X.

Because of this configuration of the outer cutter unit 50, the tip ends of the respective inner blade elements 60*a* and 60*b* of the inner cutter unit 52, which rotate while contacting the interior surfaces of the slit-form blades 58*a* and 58*b*, are also formed so as to be positioned on the same plane X.

However, the above-described conventional electric shaver has problems.

The slits 62*a* and 62*b* of the respective slit-form blades 58*a* and 58*b* of the outer cutter unit 50 extend from the inner circumferences to the outer circumferences of the respective blade formation regions 56*a* and 56*b* in a substantially radial configuration. Furthermore, the respective widths of the inner and outer blade formation regions 56*a* and 56*b* must be a certain predetermined size or greater in order to obtain a maximum possible effective shaving area created by the corresponding inner blade elements 60*a* and 60*b*. Accordingly, the slits 62*a* and 62*b* are generally greater in length than the holes formed in a foil blade of reciprocating type electric shavers. Moreover, the widths d of the slits 62*a* and 62*b* must also have a prescribed size or greater in order to effectively introduce whiskers thereinto.

Consequently, the respective slits 62*a* and 62*b* are inevitably formed large, and this results in that the skin tends to enter into these slits during shaving. Accordingly, it is necessary to form the slit-form blades 58*a* and 58*b* with a certain thickness so that the skin entering the slits 62*a* and 62*b* does not reach the inner cutter unit 52 and cause cutting injuries. Generally, shaving is done by holding the electric shaver in one hand and pressing it against the surface of the skin, moving the shaving unit 54 around on the skin; accordingly, the skin in contact with the area of the side-surface opening on the outer circumferential side of the slit-form blade 58*a* of the blade formation region 56*a* located at the outermost circumference of the outer cutter unit 50, tends to wrinkle up and easily enters the slits as indicated by arrows A. Accordingly, the thickness a of the slit-form blades 58*a* of the outermost blade formation region 56*a* must have a certain predetermined thickness in order to insure the safety of the user; and as a result, the thickness b of the slit-form blades 58*b* of the inner blade formation region 56*b* correspondingly has a certain thickness so as to conform with the thickness a.

Thus, the deep shaving of whiskers such as that performed by foil blades employed in reciprocating type electric shavers is difficult to accomplish.

SUMMARY OF THE INVENTION

Accordingly, the present invention is to solve the problems described above, and the object of the present invention is to provide an electric shaver which allows deep shaving of whiskers without damaging the skin of the user even with the use of an outer cutter unit that has a slit-form blade.

The above described object of the present invention is accomplished by a unique structure for an electric shaver which includes outer cutter units each of which is provided with a blade formation region of an annular shape with slit-form blades formed therein and inner cutter units each comprising a plurality of inner blade elements arranged in an annular configuration with tip ends contacting the interior surface of the slit-form blades of the outer cutter units while being rotated relative to the outer cutter units; and the electric shaver is characterized in that a plurality of the blade formation regions are formed in the shape of concentric circles in each of the outer cutter units, and the slit-form blades of the blade formation regions other than the outermost blade formation region are formed thinner than those of the outermost blade formation region.

In the structure described above, the slit-form blades in the outermost blade formation region of the outer cutter unit, where the entry of the skin is most likely, are thicker than that of other blade formation region(s), and therefore, the safety of the user is insured when the outer cutter units are moved while being pressed against the skin during shaving; and at the same time, since the slit-form blades of the blade formation region(s) other than the outermost blade formation region is thinner than those of the outermost blade formation region, the deep shaving of whiskers can be accomplished.

Furthermore, when the slits, which comprise the slit-form blades, in the blade formation region(s) other than the outermost blade formation region are formed in smaller number than in the outermost blade formation region, each one of the ribs, which are formed by two adjacent slits, in the blade formation region(s) other than the outermost blade formation region can have a larger circumferential width when compared to the ribs formed by slits in the same number in each blade formation region; as a result, the ribs have a larger cross-sectional area, and the strength of the outer cutter units can be assured.

In addition, by forming the radial width of the blade formation region(s) other than the outermost blade formation region to be smaller than that of the outermost blade formation region, the slits and ribs of the blade formation region(s) other than the outermost blade formation region can be shorter than those of the outermost blade formation region. As a result, the amount of bending of the ribs in the radial direction in such region(s) decreases, and deformation of the outer cutter units during shaving can be reduced. Thus the strength of the outer cutter units can be insured.

In addition, by forming the interior surfaces of the plurality of blade formation regions so as to be on the same plane, the slit-form blades formed in the outermost blade formation region has the greatest amount of protrusion, while the slit-form blades formed in the blade formation region(s) other than the outermost blade formation region is in a slightly recessed form. Accordingly, tight contact with the skin of the face, which is a curving surface, can be assured; and in addition, since the height of the tip end of the plurality of inner blade elements of the inner cutter units does not need to be different, the inner cutter units can be manufactured without any complexity.

Furthermore, by setting the thickness of the slit-form blades formed in at least one of the blade formation regions other than the outermost blade formation region to be in the range of 0.04 mm to 0.07 mm, such a thickness is substantially the same as that of a foil blade used in a reciprocating electric shaver, and deep shaving of whiskers can be accomplished in a favorable manner.

In addition, the object is accomplished by a unique structure for an electric shaver which includes outer cutter units each of which is provided with a blade formation region of an annular shape with slit-form blades formed therein and inner cutter units each comprising a plurality of inner blade elements arranged in an annular configuration with tip ends that contact the interior surface of the slit-form blades of the outer cutter units while being rotated relative to the outer cutter units, and wherein a plurality of the blade formation regions are formed in the shape of concentric circles in each of the outer cutter units, and slits that comprise the slit-form blades of the blade formation regions other than the outermost blade formation region have widths in the circumferential direction greater than slits formed in the outermost blade formation region.

DETAILED DESCRIPTION OF THE PREFERRED EMBODIMENTS

Figure 1:
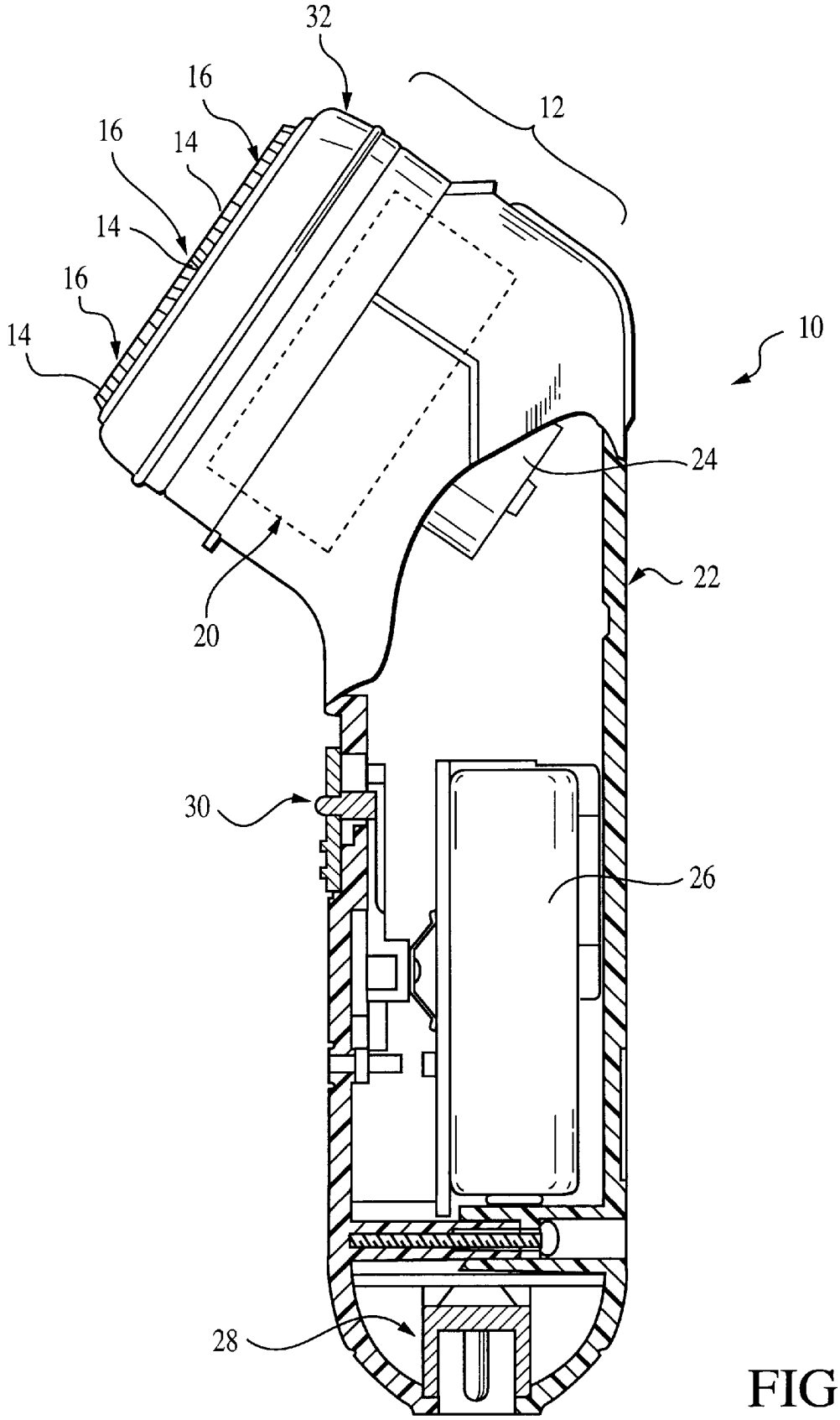
FIG. 1 is a partial cross-sectional view of the essential portions of the overall construction of the electric shaver according to the present invention.

Below, a preferred embodiment of the electric shaver according to the present invention will be described in detail with reference to the accompanying drawings. Constituting elements which are the same as in the conventional shaver are labeled with the same reference numerals, and a detailed description thereof is omitted.

First, the overall construction of the electric shaver 10 will be outlined. In the shown embodiment, an electric shaver has three shaving units each comprising a circular outer cutting unit 14 and a circular inner cutting unit 18; however, the same description is applicable to an electric shaver which has one or two shaving units, or an electric shaver which has four or more shaving units.

The upper portion of the electric shaver 10 in FIG. 1 is a shaver head 12; and three shaving units 16 are provided therein (only two clearly shown) so that outer cutter units 14 thereof are exposed out of the shaver head 12. The electric shaver 10 further includes a housing 22 which is made of a synthetic resin. The housing 22 contains therein a driving mechanism 20 for inner cutter units 1 8, an electric motor 24 located beneath the shaver head 12 so as to actuate the driving mechanism 20, a battery 26 which supplies electric current to the elect ic motor 24, a connector 28 installed in the lower end of the housing 22 so as to supply a charging current to the battery 26 from outside, and a slide switch 30 provided on the front of the housing 22 so as to be used to switch the current supply from the battery 26 to the electric motor 24 on and off.

Figure 2:
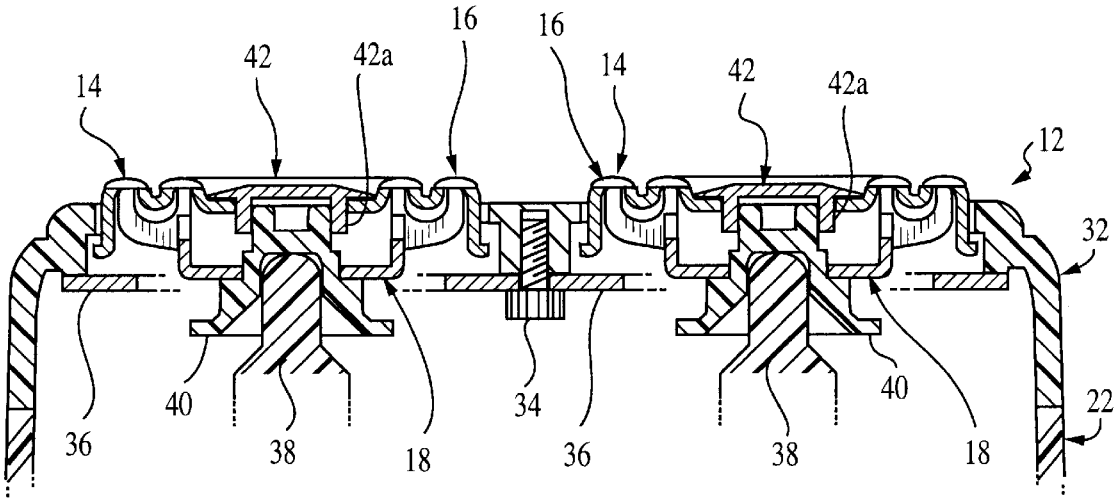
FIG. 2 is a sectional view of the essential portion of the internal structure of the head of the electric shaver shown in FIG. 1.

The internal construction of the shaver head 12 of the electric shaver 10 will be described with reference to FIG. 2.

The upper end of the shaver head 12 is open and is covered by a detachable head frame 32 which is snap-fitted to the housing 22. A cutter retainer frame 36 is removably attached to the interior surface of the head frame 32 by an attachment screw 34 so that the outer cutter units 14 and the inner cutter units 18 are held between the cutter retainer frame 36 and the head frame 32, thus preventing these cutter units 14 and 18 from falling off of the shaver head 12.

Furthermore, coupling elements 40 are attached to the central portions of the inner cutter units 18. The coupling elements 40, made of a synthetic resin, are engaged with the tip ends of drive shafts 38 (constituting a part of the driving mechanism 20) so that the inner cutter units 18 are rotated by the drive shafts 38. The tip ends (upper ends in FIG. 2) of these coupling elements 40 are loosely inserted into tubular portions 42*a* formed in the undersurfaces of disk members 42 securely attached to the central portions of the outer cutter units 14, and the centers of the inner and outer cutters 18 and 14 are thus axially aligned. The drive shafts 38 constantly urge the inner cutter units 18 upward (or toward the outer cutter units 14) by springs (not shown). The rotational force of the electric motor 24 is transmitted to the drive shafts 38 by a transmission mechanism (not shown) which comprises a gear mechanism, etc. and constitutes a part of the driving mechanism 20.

Figure 3:
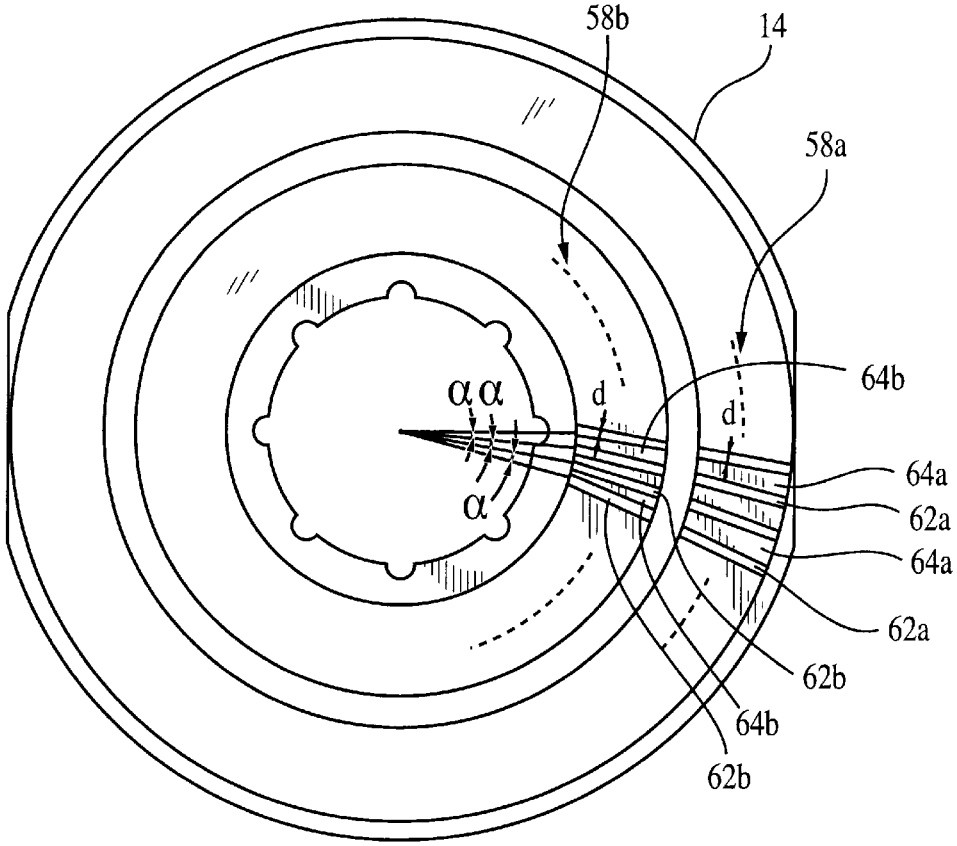
FIG. 3 is a top view of one of the outer cutter units of the present invention.

The structures of the outer cutter units 14 and inner cutter units 18, which characterize the present invention, will be described with reference to FIGS. 3 and 4.

As in the prior art shavers, two blade formation regions 56*a* and 56*b* of annular shape are formed concentrically in each one of the outer cutter units 14; and a plurality of slits 62*a* and 62*b* of the same width in the circumferential direction are formed so as to extend substantially in a radial direction in the respective blade formation regions 56*a* and 56*b*, so that slit-form blades 58*a* and 58*b* arc formed in the blade formation regions 56*a* and 56*b*. For the slit-form blades 58*a*, the side walls of each one of the ribs 64*a* formed by two adjacent slits 62*a* of the outermost blade formation region 56*a* act as blade surfaces for cutting whiskers; and likewise, for the slit-form blades 58*b*, the side walls of each one of the ribs 64*b* formed by two adjacent slits 62*b* of the inside blade formation region 56*b* act as blade surfaces for cutting whiskers as seen from FIG. 3.

Figure 4:
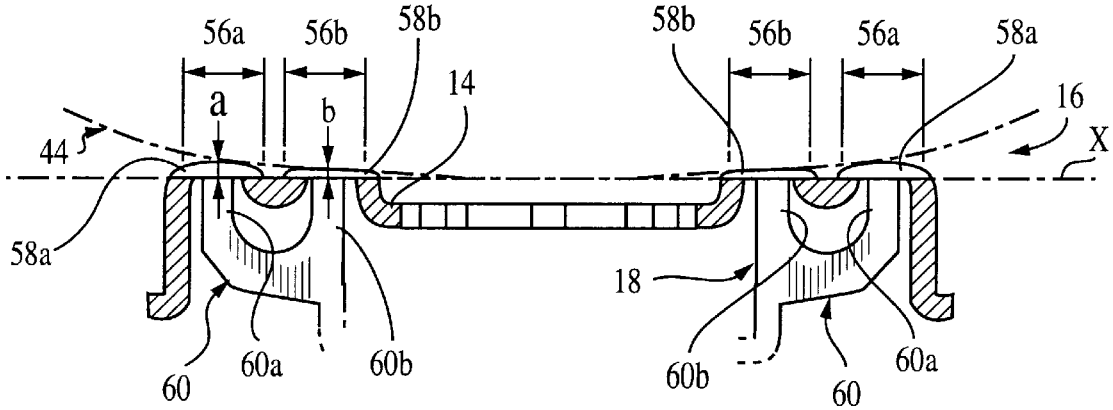
FIG. 4 is a sectional view of the outer cutter unit Shown in FIG. 3 wherein the internal surfaces of the slit-form blades are set to be on the same plane.

Furthermore, the inner cutter unit 18 has a plurality of inner blade bodies 60 (only two are shown in FIG. 4) which are disposed circumferentially. The tip ends of the respective inner blade bodies 60 are bifurcated so as to form inner blade elements 60*a* and 60*b* which contact the interior surfaces of the slit-form blades 58*a* and 58*b*, respectively. The respective inner blade elements 60*a* and 60*b* are disposed in concentric annular configurations so as to correspond to the blade formation regions 56*a* and 56*b* which are also in concentric annular configurations.

The slit-form blades 58*a* and inner blade elements 60*a* form an outside annular cutting blade assembly which is located around the outer circumference of each circular shaving unit 16, and the slit-form blades 58*b* and inner blade elements 60*b* form an inside cutting blade assembly which is located around the inner circumference of each circular shaving unit 16 as shown in FIG. 4.

As seen from FIG. 4, unlike the prior art shavers, in each of the outer cutter units 14 of the present invention, the thickness b of the slit-form blades 58*b* formed in the inside blade formation region 56*b* is designed so as to be smaller than the thickness a of the slit-form blades 58*a* formed in the outermost blade formation region 56*a* (a>b). Considering both strength and appropriate deep shaving of whiskers, a thickness of 0.04 mm to 0.07 mm, which is approximately the same thickness as that of a foil blade, is preferable for the thickness b of the slit-form blades 58*b* of the inside blade formation region 56*b*.

Furthermore, the interior surfaces of the slit-form blades 58*a* and 58*b* of the respective blade formation regions 56*a* and 56*b* are formed so that these interior surfaces are all positioned on the same plane X.

Because of the structure described above, since the slit-form blades 58*a* formed in the blade formation region 56*a* positioned at the outermost circumference of each outer cutter unit 14 (where entry of the skin is most likely) remain as thick as that of conventional electric shavers, the safety of the user is insured when the outer cutter units 14 are moved around while being pressed against the surface of the skin 44 during shaving; at the same time, since the slit-form blades 58*b* in the inside blade formation region 56*b* are formed as thin as a foil blade, deep shaving of whiskers can be accomplished by these slit-form blades 58*b*. Thus, the deep shaving of whiskers can be realized using the electric shaver 10 as a whole.

In the outer cutter unit 14 shown in FIG. 4, the slit-form blades 58*a* of the outermost blade formation region 56*a* have the greatest amount of protrusion, while the slit-form blades 58*b* located inner side thereof are slightly lower compared to the slit-form blades 58*a*. Accordingly, tight contact to the skin 44 of the face of the user, which is a curving surface, is enhanced, thus assuring efficient shaving.

In addition, since there is no need to differentiate the height of the tip ends of the plurality of inner blade elements 60*a* and 60*b* of each inner cutter unit 18, the manufacture of the inner cutter units 18 is not complicated.

Figure 5:
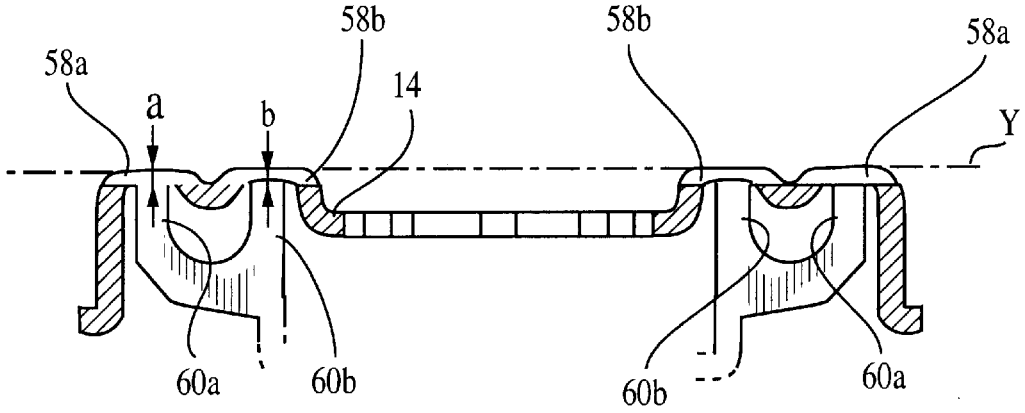
FIG. 5 is a sectional view of an outer cutter unit according to another embodiment of the present invention wherein the exterior surfaces of the slit-form blades are set to be on the same plane.

In the above embodiment, the interior surfaces of the respective slit-form blades 58*a* and 58*b* of each outer cutter unit 14 are formed so as to be all positioned on the same plane X. However, it is also possible, as shown in FIG. 5, to form the exterior surfaces of the respective blade formation regions 56*a* and 56*b* of each outer cutter unit 14, i. e., the exterior surfaces of the slit-orm blades 58*a* and 58*b*, so as to be positioned on the same plane Y. In this case, the height of the tip ends of the plurality of inner blade elements 60*a* and 60*b* of the inner cutter unit 18 varies so as to contact the interior surfaces of the slit-form blades 58*a* and 58*b*, and the inside blade elements 60*b* have a greater amount of height than the outside blade elements 60*a*.

Figure 6:
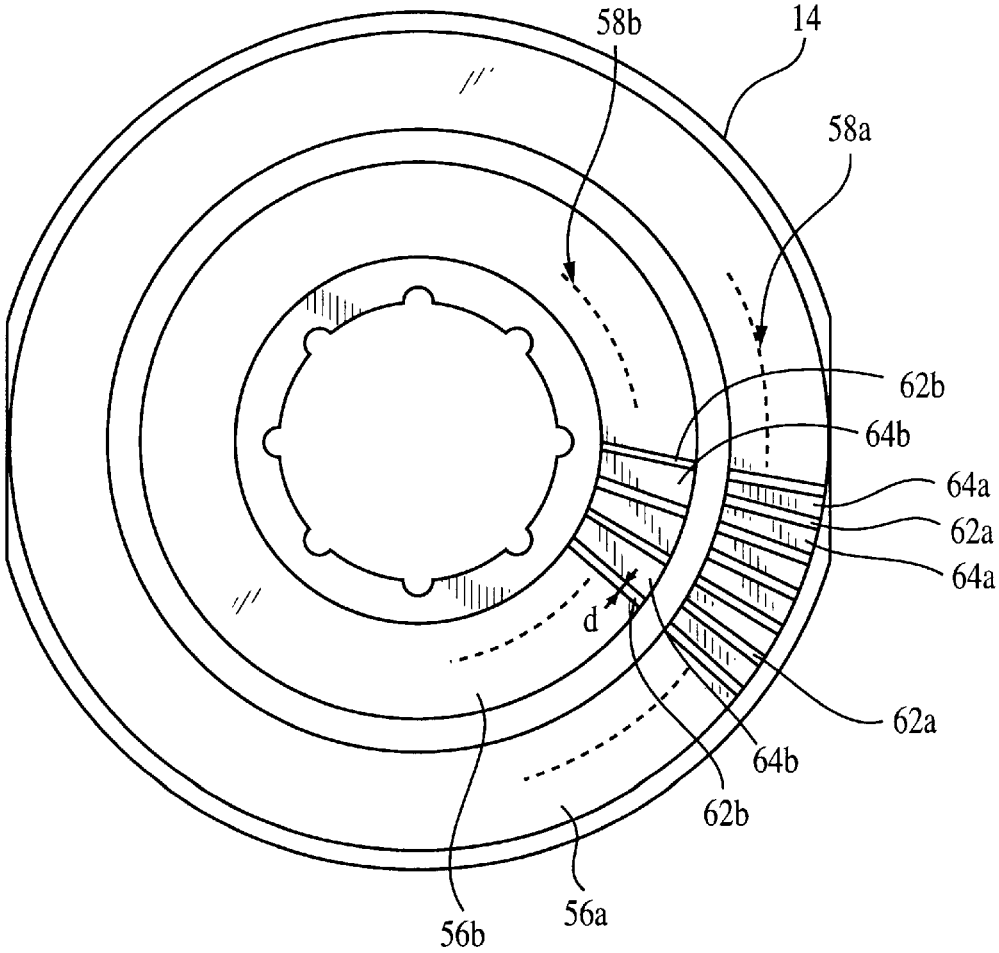
FIG. 6 is a top view of an outer cutter unit according to another embodiment of the present invention wherein the slits in the inner-side blade formation region is less in number than those in the outermost blade formation region.

In the above, since the thickness b of the inside slit-form blades 58*b* is reduced, the strength of the inside blade formation region 56*b* of the outer cutter unit 14 may drop compared to the strength obtained in a conventional electric shaver. So as to compensate this, as shown in the embodiment of FIG. 6, the inside blade formation region 56*b* is formed with a smaller number of slits 62*b* compared to the outermost blade formation region 56*a*. With this structure, the width of the ribs 64*b* in the circumferential direction of the inside blade formation region 56*b* increases accordingly; as a result, a greater cross-sectional area is obtained for the ribs 64*b* of the inside blade formation region 56*b* compared to a case in which the same number of slits 62*a* and 62*b* are formed in the blade formation regions 56*a* and 56*b*. Thus, the strength of the inside blade formation region 56*b* increases, and the strength of the outer cutter unit 14 as a whole can be insured. In FIG. 6, the number of slits 62*b* of the inside blade formation region 56*b* is set so as to be, for instance, half the number of the slits 62*a* of the outermost blade formation region 56*a*. However, this ratio may be selected as desired in accordance with the radial width of the blade formation region 56*b*, width d of the slits 62*b* and the thickness of the outer cutter unit 14, etc.

Figure 7:
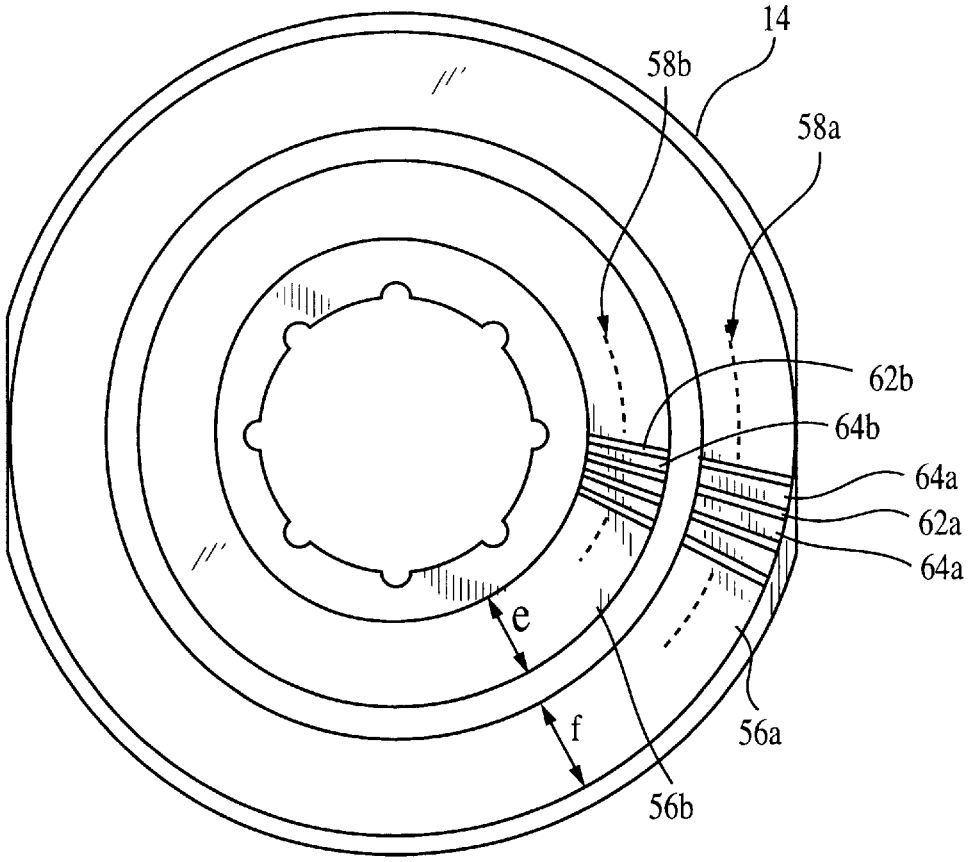
FIG. 7 is top view of an outer cutter unit according to still another embodiment of the present invention wherein the width of the inner-side blade formation region is narrower than that of the outermost blade formation region.
Figure 8:
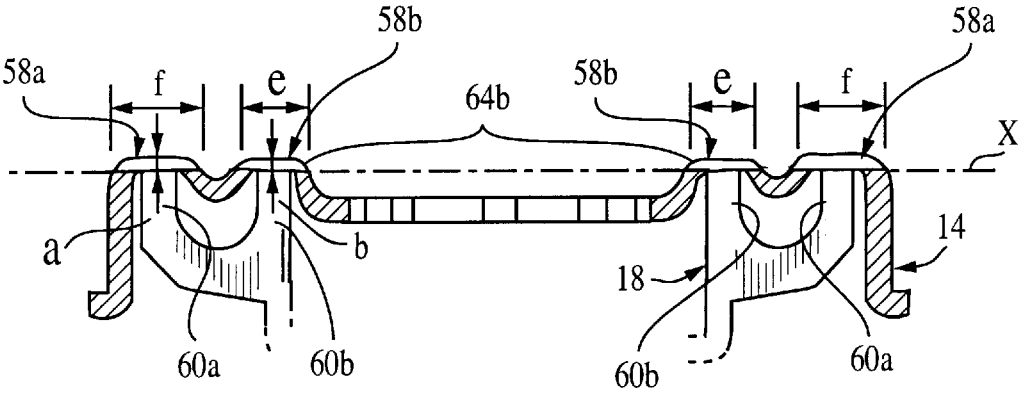
FIG. 8 is a sectional view of FIG. 7.
Figure 10:
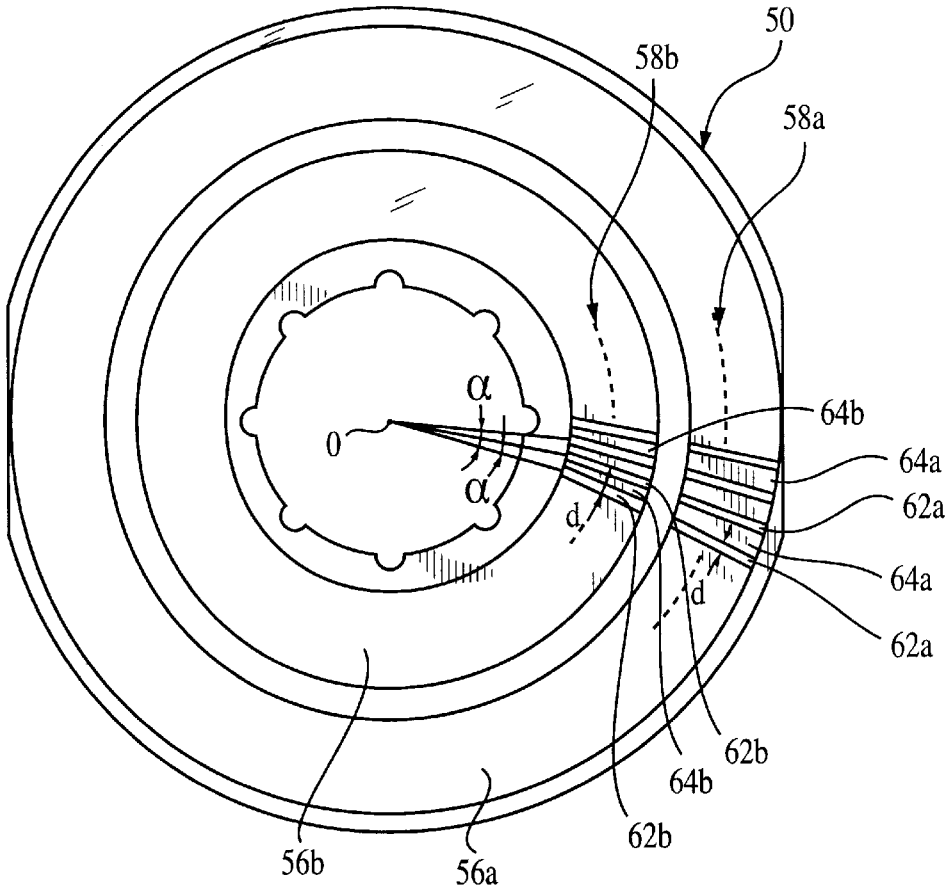
FIG. 10 PRIOR ART
FIG. 10 is a top view of a conventional outer cutter unit.
Figure 11:
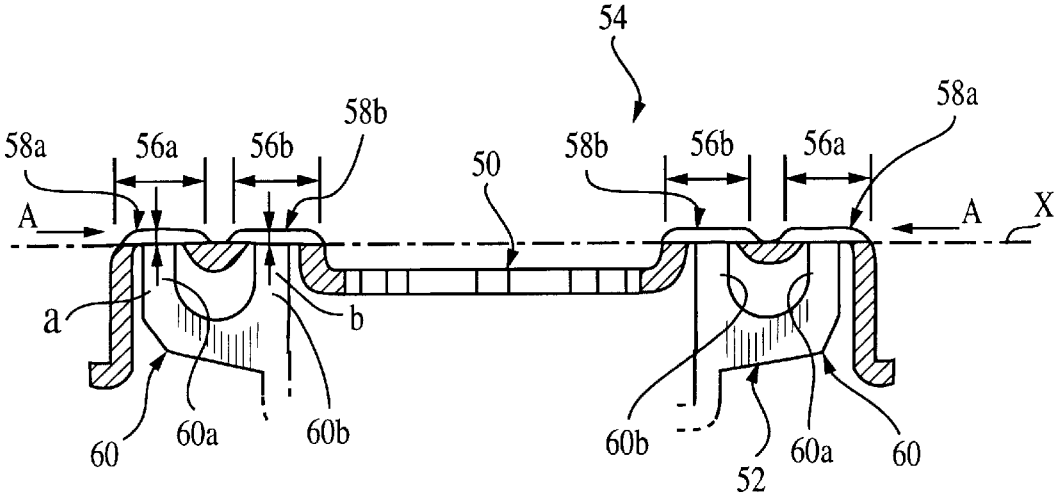
FIG. 11 PRIOR ART
FIG. 11 is a sectional view thereof.

Likewise, as shown in FIGS. 7 and 8, the width e of the inside blade formation region 56*b* in the radial direction may be made smaller than the width f of the outermost blade formation region 56*a* in order to avoid a drop in the strength of the outermost blade formation region 56*b* of each outer cutter unit 14. With this structure, since the lengths of the slits 62*b* and ribs 64*b* in the inside blade formation region 58*b* are shortened, the thickness b of the inside slit-form blades 58*b* which is reduced does not cause the amount of bending of the ribs 64*b* in the radial direction to increase, and therefore, deformation of the outer cutter unit 14 during shaving can be reduced. Accordingly, the strength of the outer cutter unit 14 can be insured.

Figure 9:
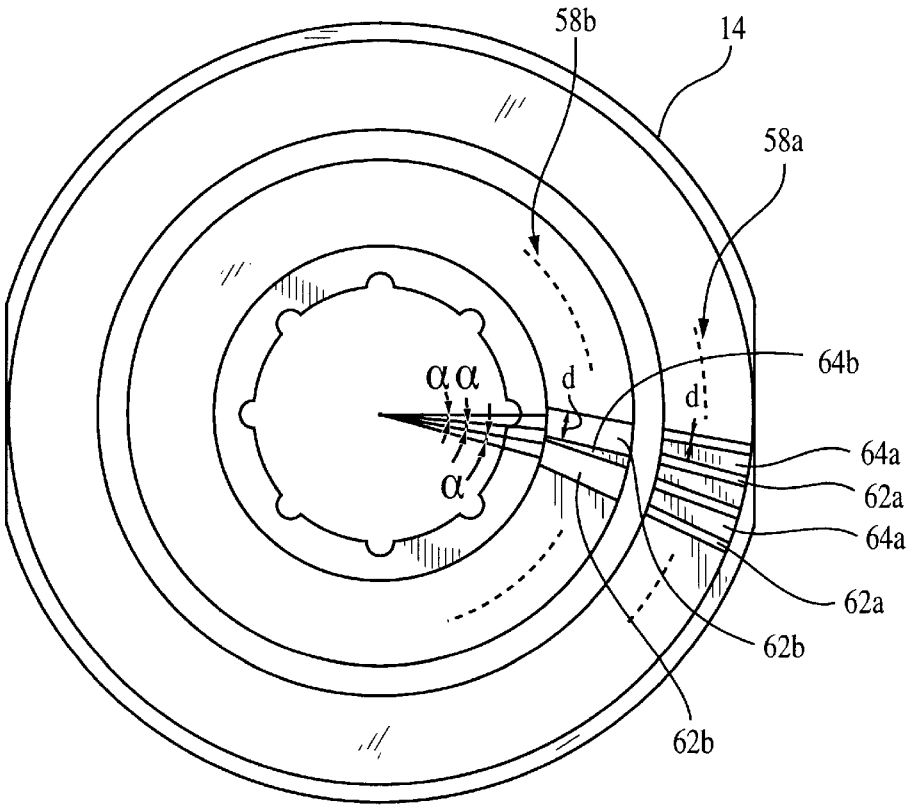
FIG. 9 is top view of an outer cutter unit according to another embodiment of the present invention wherein the width of the slits formed in the inner-side blade formation region is greater than that of the outermost blade formation region.

In the embodiment shown in FIG. 9, the width d of the slits 62*b* of the inside blade formation region 56*b* in the circumferential direction is set to be larger than the width d of the slits 62*a* of the outermost blade formation region 56*a*. As a result of this formation, it is possible to perform deep shaving due to the wider slits 62*b*, and this effect can be obtained even if the slit-form blades 58*a* of the outermost blade formation region 56*a* and the slit-form blades 58*b* of the inside blade formation region 56*b* have the same thickness.

In the embodiments described above, the blade formation regions of the outer cutter units 14 and the inner blade elements of the inner cutter units 18 are formed in a dual annular configuration; however, the same construction can be employed even in cases where the slit-form blades and inner blade elements are formed in a multiple configuration such as a triple, quadruple or even greater multiple annular configurations. In any construction in which a plurality of blade formation regions are formed in the outer cutter unit, it is sufficient if the slit-form blades of the blade formation region(s) other than the outermost blade formation region, i. e., the blade formation regions located near the center, are formed thinner than the slit-form blades of the outermost blade formation region or have wider slits than those of the outermost blade formation region.

Various descriptions are given above with reference to preferred embodiments of the present invention. However, the present invention is not limited to the embodiments described above, and it goes without saying that many modifications may be made without departing from the spirit of the present invention.

According to the electric shaver of the present invention, when the outer cutter units are moved while being pressed against the surface of the skin during shaving, the safety of the user is insured since the slit-form blades formed in the blade formation region located at the outermost circumference of each outer cutter unit, where entry of the skin is most likely, is formed thicker than other slit-form blades; and at the same time, the thickness of the slit-form blades in the other blade formation region(s) is made smaller so that deep shaving of whiskers can be accomplished.

Furthermore, though the inside slit-form blades are formed thinner, since the area of opening by such slit-form blades is small, the strength of the outer cutter units is insured.

In addition, the slit-form blades of the outermost blade formation region of each outer cutter unit have the greatest amount of protrusion, and the slit-form blades in other blade formation regions located near the center of the outer cutter unit are slightly depressed; accordingly, tight contact to the skin of the face, which has curved surfaces, is enhanced; and efficient shaving can be accomplished.

What is claimed is:

1. An electric shaver comprising an outer cutter unit provided with a plurality of slits that form slit-form blades in a plurality of separate blade formation regions of annular shape and an inner cutter unit provided with a plurality of inner blade elements arranged in an annular configuration with tip ends thereof contacting interior surfaces of said slit-form blades in said plurality of separate blade formation regions and rotated relative to said outer cutter unit, wherein said plurality of separate blade formation regions are formed in a shape of at least two concentric spaced apart circles in said outer cutter unit, said at least two concentric spaced apart circles comprising an outermost blade formation region, at least one inner blade formation region coaxially within said outermost blade formation region, a thickness of said slit-form blades in said inner blade formation region is formed smaller than a thickness of said slit-form blades in said outermost blade formation region and each of the plurality of inner blade elements is bifurcated and disposed in at least two separate concentric annular configurations corresponding to said at least two concentric spaced apart circles of said outer cutter unit.

2. An electric shaver according to claim 1, wherein interior surfaces of said slit-form blades formed in said blade formation regions are positioned on a same plane.

3. An electric shaver according to claim 1, wherein a thickness of said slit-form blades formed in said blade formation region other than said outermost blade formation region is in the range of 0.04 mm to 0.07 mm.

4. An electric shaver according to claim 1, wherein exterior surfaces of said slit-form blades formed in said blade formation regions are positioned on a same plane.

* * * * *

UNITED STATES PATENT AND TRADEMARK OFFICE

CERTIFICATE OF CORRECTION

PATENT NO. : 6,199,282 B1
DATED : March 13, 2001
INVENTOR(S) : Hiromi Uchiyama et al.

It is certified that error appears in the above-identified patent and that said Letters Patent is hereby corrected as shown below:

Title page,
Item [73], Assignee, change "Izuma Products Company, Nagano (JP)" to
-- Izumi Products Company, Nagano (JP) --

Signed and Sealed this

Twenty-seventh Day of August, 2002

*Attest:*

*Attesting Officer*

JAMES E. ROGAN
*Director of the United States Patent and Trademark Office*